US009725831B2

(12) United States Patent
Vanderjeugt et al.

(10) Patent No.: US 9,725,831 B2
(45) Date of Patent: Aug. 8, 2017

(54) MODULE SUITABLE FOR INSTALLATION IN A JACQUARD MACHINE

(71) Applicant: NV MICHEL VAN DE WIELE, Kortrijk/Marke (BE)

(72) Inventors: Bram Vanderjeugt, Ieper (BE); Günther Devloo, Lichtervelde (BE); John Andrew Griffiths, Newcastle (GB)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 0 days.

(21) Appl. No.: 14/443,765

(22) PCT Filed: Nov. 18, 2013

(86) PCT No.: PCT/IB2013/002577
§ 371 (c)(1),
(2) Date: May 19, 2015

(87) PCT Pub. No.: WO2014/076558
PCT Pub. Date: May 22, 2014

(65) Prior Publication Data

US 2015/0299912 A1 Oct. 22, 2015

(30) Foreign Application Priority Data

Nov. 19, 2012 (BE) ..... 2012/0779

(51) Int. Cl.
*D03C 3/20* (2006.01)
*D03C 3/24* (2006.01)
*D03C 3/00* (2006.01)

(52) U.S. Cl.
CPC *D03C 3/24* (2013.01); *D03C 3/20* (2013.01)

(58) Field of Classification Search
CPC ... D03C 3/20; D03C 3/24; D03C 3/12; D03C 13/00; D03C 3/40; D03C 3/06;
(Continued)

(56) References Cited

U.S. PATENT DOCUMENTS 3,103,953 A * 9/1963 Lauritsen ..... D03C 5/06 139/455
3,240,235 A * 3/1966 Burgess ..... D03D 39/226 139/25

(Continued)

FOREIGN PATENT DOCUMENTS

DE 19547764 A1 6/1996
EP 0214075 A1 3/1987

OTHER PUBLICATIONS

International Search Report dated Jul. 18, 2014.

*Primary Examiner* — Bobby Muromoto, Jr.
(74) *Attorney, Agent, or Firm* — Symbus Law Group. LLC; Clifford D. Hyra

(57) ABSTRACT

A module suitable for installation in a jacquard machine, comprising at least one partition provided for guiding shed-forming elements, wherein the shed-forming elements comprise at least one anchor element which is configured to be held pressed against a contact profile of the jacquard machine when the module has been installed in the jacquard machine, wherein said anchor element is displaceable from a first position of use to a second removal position for removing the module from the jacquard machine.

13 Claims, 18 Drawing Sheets

(58) Field of Classification Search
CPC ... D03C 3/42; D03C 3/44; D03C 3/00; D03C 3/10; D03C 5/02; D03C 5/06; D03C 49/60; D03C 47/262; D03C 49/02; D03C 49/04; D03C 51/005; D03C 51/02
See application file for complete search history.

(56) References Cited

U.S. PATENT DOCUMENTS 4,427,114 A * 1/1984 Howell ..... H05K 9/0067 206/454
4,515,186 A * 5/1985 Durville ..... D03C 3/20 139/319
4,563,722 A * 1/1986 Maroney ..... H05K 7/1425 206/709
4,593,723 A * 6/1986 Griffith ..... D03C 3/20 139/455
4,739,806 A * 4/1988 Palau ..... D03C 3/24 139/455
4,936,357 A * 6/1990 Keim ..... D03C 3/20 139/455
5,002,099 A * 3/1991 Seiler ..... D03C 3/20 139/455
5,038,837 A * 8/1991 Palau ..... D03C 3/12 139/455
5,092,369 A * 3/1992 Derudder ..... D03C 3/24 139/65
5,309,953 A * 5/1994 Bassi ..... D03C 3/20 139/455
5,355,911 A * 10/1994 Kuster ..... D03C 3/20 139/383 AA
5,363,884 A * 11/1994 Migliorini ..... D03C 3/20 139/455
5,628,347 A * 5/1997 Rush ..... D03C 3/24 139/455
5,669,248 A * 9/1997 Mista ..... D04B 27/32 66/205
5,671,784 A * 9/1997 Dewispelaere ..... D03C 3/20 139/455
5,839,481 A * 11/1998 Bassi ..... D03C 3/24 139/455
5,868,173 A * 2/1999 Derudder ..... D03C 3/24 139/21
6,073,663 A * 6/2000 Dewispelaere ..... D03C 3/06 139/455
6,085,803 A * 7/2000 Dewispelaere ..... D03C 3/06 139/455
6,186,186 B1 * 2/2001 Debaes ..... D03C 3/12 139/21
6,336,478 B2 * 1/2002 Puype ..... 139/88
6,880,582 B2 * 4/2005 Vanderjeugt ..... D03C 3/40 139/59
7,000,647 B2 * 2/2006 Vanthournhout ..... D03C 3/42 139/60
7,025,094 B2 * 4/2006 Vanderjeugt ..... D03C 3/44 139/59
7,150,296 B2 * 12/2006 Vanderjeugt ..... D03C 3/12 139/59
7,168,454 B2 * 1/2007 Vanderjeugt ..... D03C 3/38 139/55.1
7,320,343 B2 * 1/2008 Speich ..... D03C 3/10 139/110
7,464,729 B2 * 12/2008 Vanderjeugt ..... D03C 3/36 139/55.1
7,493,920 B2 * 2/2009 Vanderjeugt ..... D03C 1/16 139/55.1
7,503,352 B2 * 3/2009 Vanderjeugt ..... D03C 3/40 139/116.1
7,506,668 B2 * 3/2009 Vanderjeugt ..... D03C 1/00 139/58
7,610,939 B2 * 11/2009 Vanderjeugt ..... D03C 3/36 139/59
7,798,178 B2 * 9/2010 Vanthournout ..... D03C 3/06 139/55.1
8,408,249 B2 * 4/2013 Lorup ..... D03D 49/60 139/1 E
8,720,492 B2 * 5/2014 Vanderjeugt ..... D03C 3/24 139/455
9,080,266 B2 * 7/2015 Debaes ..... D03D 27/10
9,091,001 B2 * 7/2015 Graham ..... D03C 3/20
2001/0004905 A1 * 6/2001 Puype ..... D03C 3/06 139/55.1
2003/0221737 A1 * 12/2003 Vanderjeugt ..... D03C 3/40 139/88
2004/0003859 A1 * 1/2004 Vanthournhout ..... D03C 3/42 139/85
2004/0035488 A1 * 2/2004 Vanderjeugt ..... D03C 3/44 139/55.1
2004/0159361 A1 * 8/2004 Vanderjeugt ..... D03C 3/38 139/91
2004/0244861 A1 * 12/2004 Vanderjeugt ..... D03C 3/12 139/59
2005/0081940 A1 * 4/2005 Vanthournout ..... D03C 3/06 139/55.1
2006/0065321 A1 * 3/2006 Vanderjeugt ..... D03C 1/16 139/55.1
2006/0207675 A1 * 9/2006 Vanderjeugt ..... D03C 3/36 139/59
2006/0231274 A1 * 10/2006 Vanderjeugt ..... D03C 1/00 172/40
2006/0249219 A1 * 11/2006 Vanderjeugt ..... D03C 3/36 139/87
2007/0028986 A1 * 2/2007 Vanderjeugt ..... D03C 3/40 139/55.1
2007/0102057 A1 * 5/2007 Vanderjeugt ..... D03C 3/12 139/37
2012/0285578 A1 * 11/2012 Vanderjeugt ..... D03C 3/24 139/455
2013/0291996 A1 * 11/2013 Graham ..... D03C 3/20 139/66 R
2015/0122367 A1 * 5/2015 Vanderjeugt ..... D03C 3/40 139/85
2015/0275405 A1 * 10/2015 Graham ..... D03C 3/20 139/55.1
2015/0299912 A1 * 10/2015 Vanderjeugt ..... D03C 3/24 139/59

* cited by examiner

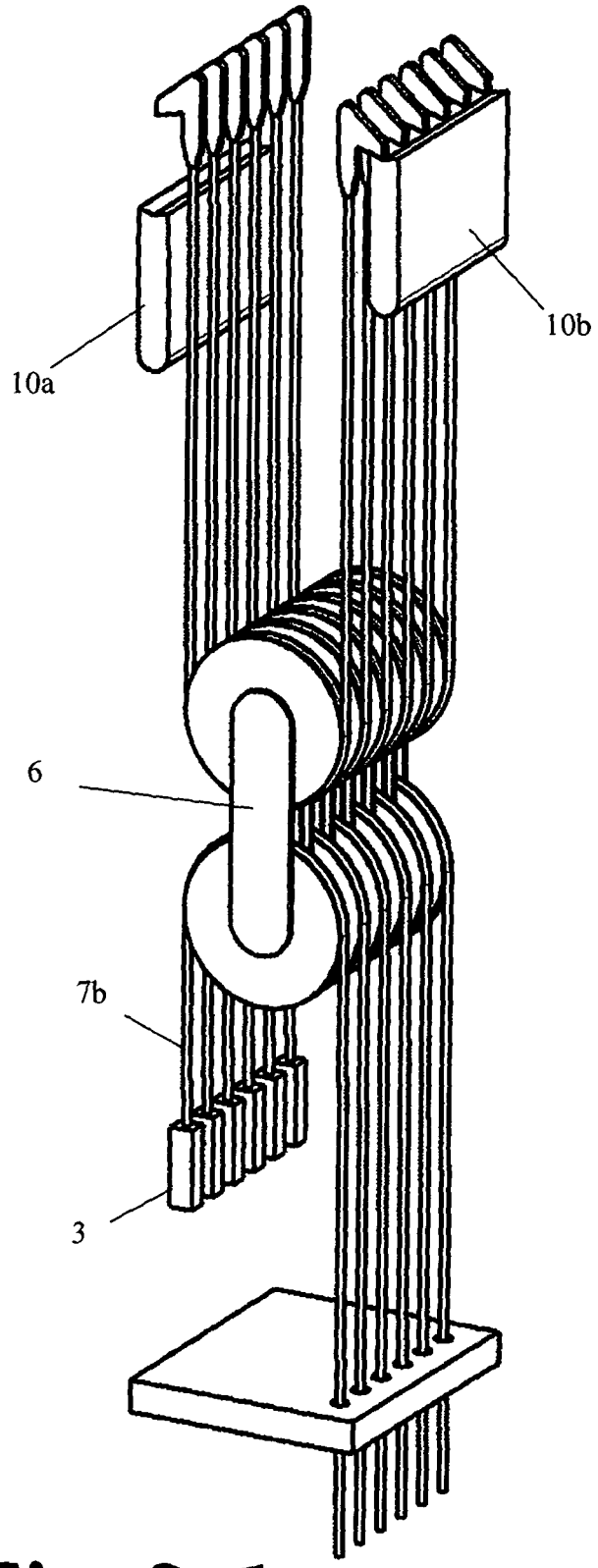
Fig. 3c1

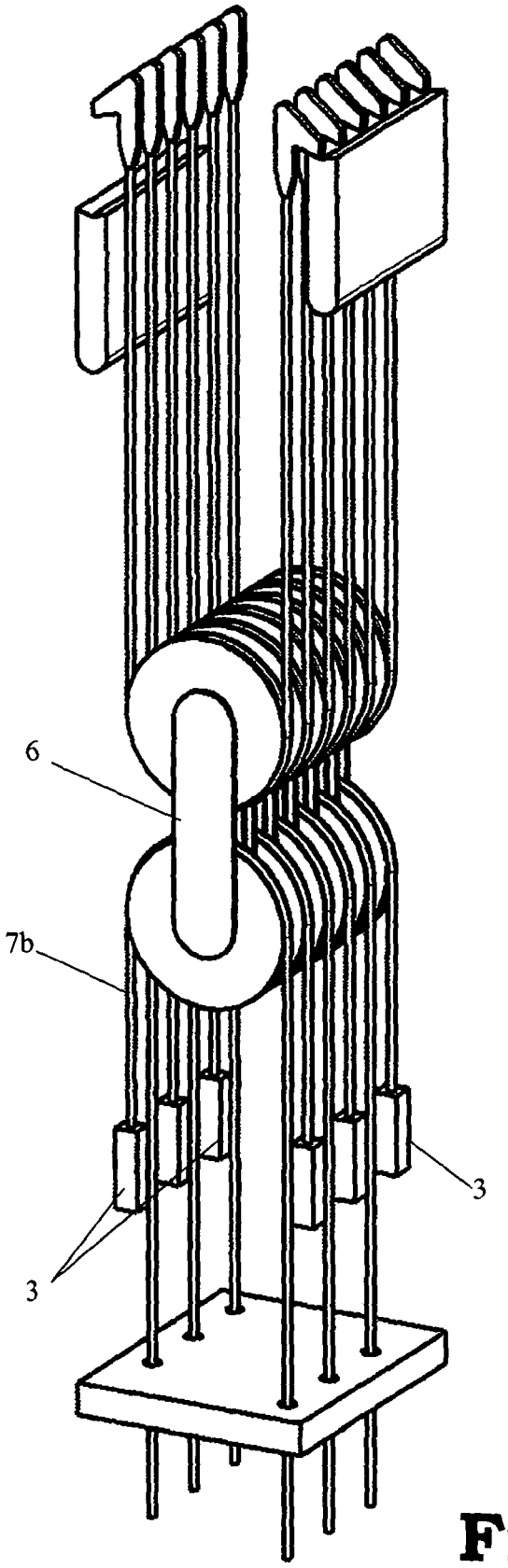
Fig. 3c2

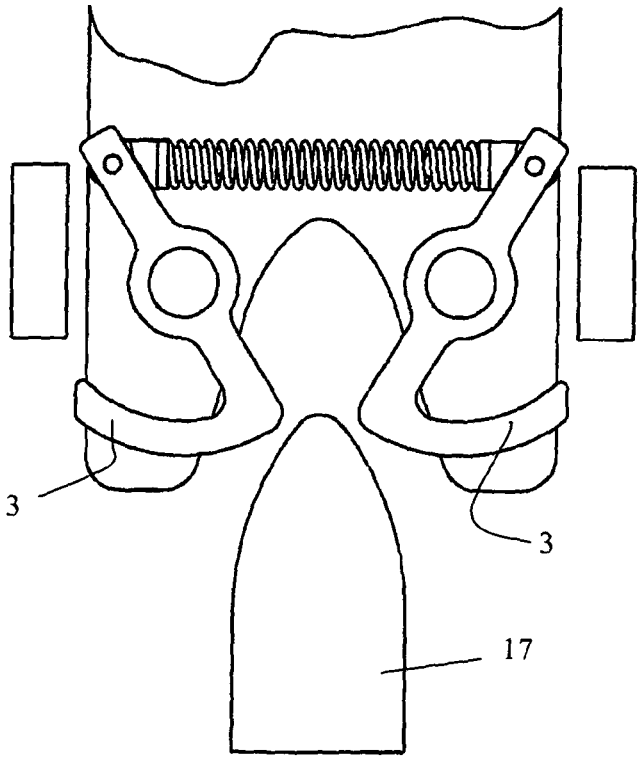
Fig. 7.1
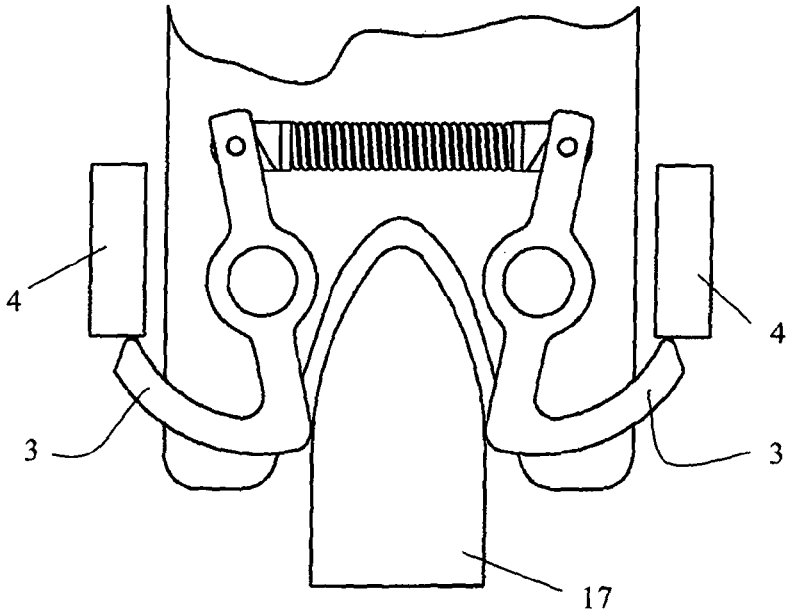
Fig. 7.2

MODULE SUITABLE FOR INSTALLATION IN A JACQUARD MACHINE

This application claims the benefit of Belgian patent applications No. BE-2012/0779, filed Nov. 19, 2012, which is hereby incorporated by reference in its entirety.

FIELD OF THE INVENTION

The present invention relates, on the one hand, to a module suitable for installation in a jacquard loom, comprising shed-forming elements and at least one partition provided for guiding the shed-forming elements, wherein the shed-forming elements comprise at least one anchor element which is configured to be held pressed against a contact profile of the jacquard loom when the module has been installed in the jacquard loom.

Secondly, the present invention relates to a jacquard loom provided with such a module.

BACKGROUND

Jacquard looms are used in order to take the warp threads in a weaving loom to the correct position so as to produce, in combination with the weft threads, the desired weave structure with a desired pattern. This is the case for flat weaving looms wherein warp threads are taken to the correct position before the weft is introduced in order to form the desired weave structure and figure, together with the weft threads. This is also the case with face-to-face weaving looms, wherein pile-warp threads and/or ground warp threads are taken to the correct position before the weft is introduced, so that the pile-warp threads and/or ground warp threads can form the desired figure and weave structure with the weft threads.

Such a jacquard loom comprises at least two rows of hooks and at least two knives, each of which continually moves up and down in counterphase opposite a row of hooks and each of which can take along or not take along the hooks of said row. Whether or not the hooks are taken along is controlled by so-called selection elements which retain the hooks during one or several cycles when the hooks of the jacquard loom are in the top or bottom position (depending on the design). Two hooks, which are connected to each other by means of an upper hoisting cord which is passed around a hoisting wheel and each of which is moved by a knife, in which case the two respective knives move in counterphase, form a complementary hook pair. Often, these hooks are situated exactly opposite each other and the same selection element controls whether or not they are taken along by the knives. However, these hooks may also be influenced by various selection elements.

When they are optionally selected or not selected, hooks of one or two complementary hook pairs assume different positions. By assuming these different positions, by a cooperation between these hooks and the hoisting wheels of hoists and reversing rollers which is imposed by the mutual connection, by the upper hoisting cords and lower hoisting cords which are turned over these hoisting wheels and, if desired, over reversing rollers, and by connecting these hoisting cords, via harness cords, to one or more heddles which are provided with an opening through which a warp thread passes, these cooperating hooks take the associated warp threads to the desired height in order to produce a fabric with a well-defined pattern. The upper hoisting cord connects the ends of two complementary hooks. The lower hoisting cord is connected to the harness cord.

At its one end which is connected to one or more heddles via one or more harness cords, the lower hoisting cord is subjected to a tensile force exerted by springs which are connected to the heddle(s), and at its other end may be held in a fixed point of the module or to another part of the jacquard device which determines the position of the end.

A jacquard device may additionally be provided with setting means which enable setting of a number of lower hoisting cords per group, so that their reciprocating movement takes place at a different height. This makes it possible, for example, to place a group of yarns which is moved by this group of lower hoisting cords in a different layer, in their end position, than the yarns of another group.

By means of these setting means, it is not only possible to adjust the height of the heddle eyelets of the jacquard heddles attached to the harness cords without having to adjust the height of the entire jacquard loom, but they also provide an additional facility for control.

The jacquard looms are constructed to be as compact as possible in order to fit as many hooks and associated selection elements and hoist systems as possible on a specific surface area. The selection elements are becoming increasingly smaller and the hoist systems have to follow this trend for miniaturization. A hoisting device requires regular maintenance and checks, for example to replace defective or worn or ruptured hoisting cords or hoists. Thus, an operative has to work his way through the other hoists and hoisting cords in order to replace the defective or worn hoist or cord.

However, replacing or repairing hoisting cords when they are ruptured or worn is time-consuming.

In order to limit the downtime of the jacquard during rupture or during maintenance work, specific modules have been developed incorporating the different components of the hoist system.

Such a module in which the movable shed-forming means, the selection devices and the hoisting device of several shed-forming mechanisms are combined, is described in European patent publication EP 0 214 075. However, this known module has the following drawbacks: if one or more selection devices have to be repaired or replaced or have to be removed for maintenance, the harness cords which cooperate with the hoisting devices provided in the module have to be unhooked before the module can be removed. After a module has been put back in place, these harness cords have to be hooked back in. Having to unhook and hook the harness cords back in is laborious and time-consuming.

Furthermore, when such a module is replaced due to rupture or wear of one or more hoisting cords, the intact and expensive selection devices which are fitted in the same module are also replaced.

In order to solve, inter alia, the abovementioned problems, the European patent publication EP 0 801 161 describes a shed-forming device which comprises a separately removable selection module containing the selection elements and a separately removable hoisting module containing the hoists and the shed-forming means (hooks).

However, both modular solutions (the one from EP 0 214 075 in FIGS. 6 and 7, and the one from EP 0 801 161) suffer from the drawback that the tensile force of the springs is transferred completely to the module itself and that, during normal operation of the jacquard device, a force which is to be prevented is exerted in the direction in which the module is removed, namely in the direction in which the knives move and away from the heddles; in a normal embodiment, this will be mainly vertically upwards. This has the drawback that the module is subjected to unnecessary loads, which may result in deformation which is disadvantageous with regard to the good guidance of the components which are situated therein.

In addition, an additional provision has to be made to prevent the module from sliding upwards during operation of the jacquard device, for example in the form of additional clamping or connecting elements.

SUMMARY

It is now an object of the present invention to provide a module for guiding one or more anchor elements in a jacquard loom which solves the drawbacks of the above-mentioned embodiments and which can be removed from the jacquard loom in a quick and simple manner.

The object of the invention is achieved by providing a module suitable for installation in a jacquard loom, comprising shed-forming elements and at least one partition provided for guiding the shed-forming elements, wherein the shed-forming elements comprise at least one anchor element which is configured to be held pressed against a contact profile of the jacquard loom when the module has been installed in the jacquard loom, wherein said anchor element is displaceable from a first position of use to a second removal position for removing the module from the jacquard loom.

Preferably, the shed-forming elements comprise: hooks, hoists, one or more hoisting cords.

Due to the fact that the anchor element is configured to be displaceable, a module provided with such an anchor element has the significant advantage that it can easily be mounted in and can readily be removed from the jacquard loom. In addition, efficiency during fitting and maintenance of the jacquard loom will significantly increase.

The module with anchor elements according to the invention may also contain other shed-forming elements of a jacquard, such as the associated hoisting cords, hoists and even the hooks. The module can then be described as a hoist module.

In a preferred embodiment of the module according to the invention, said anchor element is configured to be connected to a hoisting cord which is configured to be connected to a part of the hoist system or of the harness belonging to a jacquard loom.

According to a specific embodiment of the module, the anchor element exerts a pressing force on a contact profile in a direction which coincides substantially with the direction in which the module is removed from the jacquard loom. Preferably, said contact profile is a setting profile.

According to a preferred embodiment, the module is configured to contact the associated contact profiles, via the anchor elements, when the anchor elements are in the position of use, during normal operation of the jacquard, and the module is furthermore configured not to contact these contact profiles, via the anchor elements, when the anchor elements are in the removal position.

To this end, the anchor elements may be situated on the lateral outer sides of the module in order to there contact contact profiles which are also situated on the lateral outer sides, when installed in the jacquard loom. On the other hand, the anchor elements may also be situated on the inner side of the module, in which case the module is then provided with a groove in relation to which the anchor elements protrude and which provides space for an associated contact profile.

According to a first preferred embodiment of the module according to the present invention, said partition comprises a guide means which is configured to guide the anchor element during its displacement from the first position of use to the second removal position. To this end, said guide means preferably has a course which allows the anchor element to be moved laterally when removing the module, thanks to the contact of the anchor element with the contact profile. In particular, the guide means is a groove.

In a more preferred embodiment of the module according to the invention, the anchor element comprises at least one protrusion which can be guided in said guide means. Preferably, the anchor element comprises in each case two spaced-apart protrusions on its front and rear side, each of which can be guided in said guide means.

Preferably, the guide means, in a first part, extends in a first direction along the removal direction of the module and, in a second part, extends in a second direction which differs from the first. The first part of the guide means then makes it possible to provide a setting range for the height of the anchor point by configuring the contact profile as a setting profile which can assume different positions along to the first direction of the guide means.

According to a second preferred embodiment of the module according to the invention, said anchor element is rotatable from the first position of use to the second removal position.

In a more particular embodiment of the module, each hoist is provided with at least two hoisting wheels, around which the one or more hoisting cords are guided.

In a most particular embodiment of the module according to the invention, said module is a hoist module comprising at least one partition provided for guiding hooks, hoists and one or more hoisting cords in a jacquard loom.

Another subject of the present invention is a jacquard loom provided with a contact profile, preferably an adjustable or even a controllable setting profile, wherein the jacquard loom comprises at least one module according to the invention as described above.

BRIEF DESCRIPTION OF THE DRAWINGS

The present invention will now be explained in more detail by means of the following detailed description of a module provided for fastening and guiding one or more hoisting cords in a jacquard loom according to the invention. The sole aim of this description is to give an illustrative example and to indicate further advantages and features of this invention, and can therefore by no means be interpreted as a limitation of the area of application of the invention or of the patent rights defined in the claims.

In this detailed description, reference numerals are used to refer to the attached drawings, in which:

FIG. 3*c*1 shows a number of hook systems lying on the same knife pair, in which all associated anchor elements can contact one setting profile;

FIG. 3*c*2 shows a number of hook systems lying on the same knife pair, in which all associated anchor elements can contact two different setting profiles;

FIGS. 7.1 and 7.2 show an alternative embodiment, in which the anchor element rotates between its first and second position.

DETAILED DESCRIPTION OF EMBODIMENTS

Figure 1:
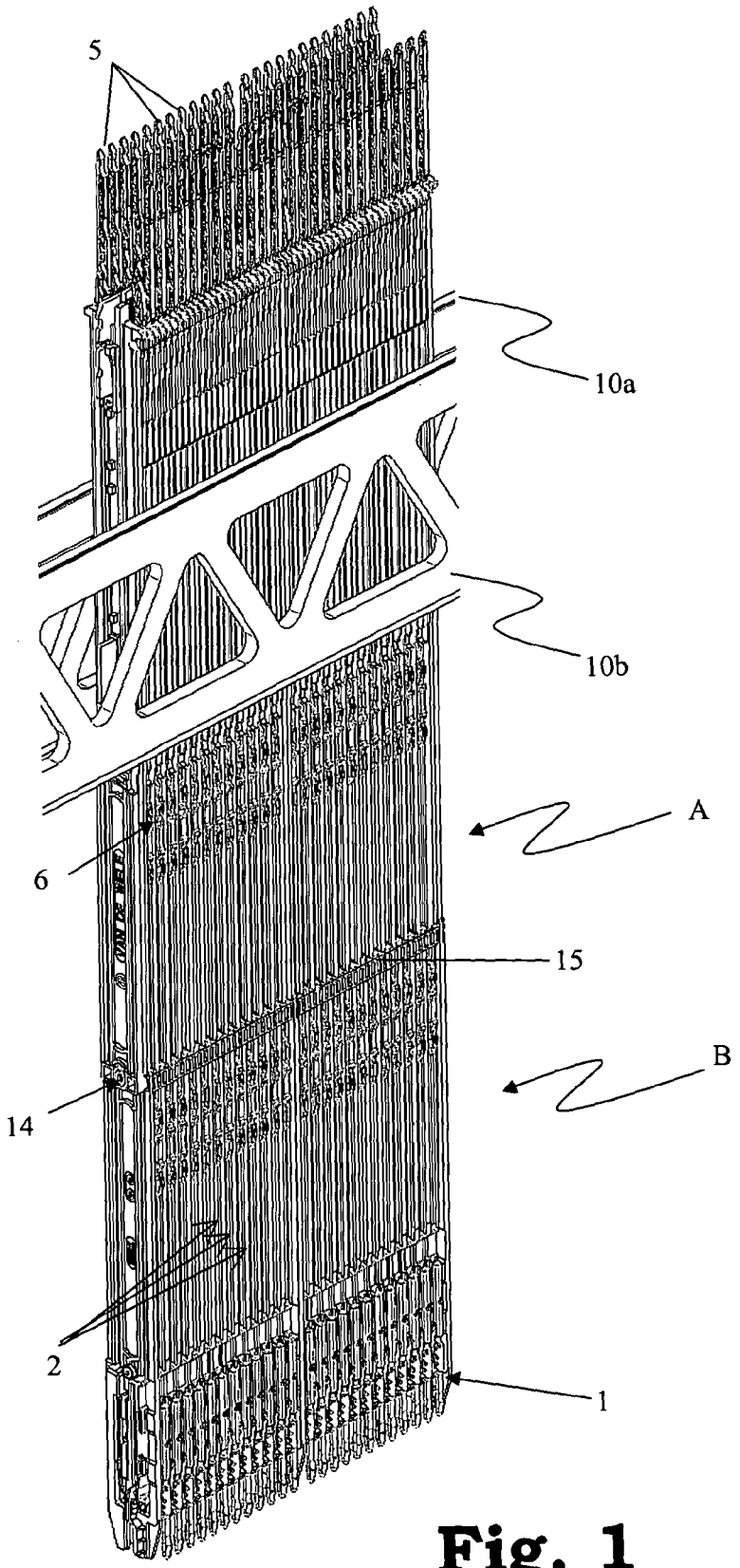
FIG. 1 shows a view of a number of adjacent multiple partitions which illustrates the positioning with respect to the knives.

FIGS. 3*a*, 3*b*, 3*d*, 4*a* to 4*d*, 5*a* to 5*d*, 6*a* and 6*b* in each case show a slightly slanting position on the left-hand side in order to clearly show the number of elements per hoist system, and a complete side view of a part of a hoist module on the right-hand side.

As indicated above, a jacquard loom according to the invention comprises (see inter alia FIG. 3*a*) at least two rows of hooks (5*a*, 5*b*) and at least two knives (10*a*, 10*b*), each of which continually moves up and down in counterphase opposite a row of hooks and each of which can take along or not take along the hooks of said row. Whether or not the hooks (5*a*, 5*b*) are taken along is controlled by so-called selection elements (not shown in the figures) which retain the hooks (5*a*, 5*b*) during one or several cycles when the hooks (5*a*, 5*b*) of the jacquard loom are in the top or bottom position (depending on the design). Two hooks (5*a*, 5*b*), which are connected to each other by means of an upper hoisting cord (7*a*) which is passed around a hoisting wheel (11) and each of which is moved by a knife (10*a*, 10*b*), in which case the two respective knives (10*a*, 10*b*) move in counterphase, form a complementary hook pair (5). Often, these hooks are situated exactly opposite each other and the same selection element controls whether or not they are taken along by the knives. However, these hooks may also be influenced by various selection elements.

When they are optionally selected or not selected, hooks of one or two complementary hook pairs assume different positions. By assuming these different positions, by a cooperation between these hooks (5*a*, 5*b*) and hoisting wheels (11, 12) of hoists (6) and optional reversing rollers (13) which is imposed by the mutual connection, by the upper hoisting cords (7*a*) and lower hoisting cords (7*b*) which are turned over these hoisting wheels (11, 12) and, if desired, over reversing rollers (13), and by connecting these hoisting cords, via harness cords, to one or more heddles which are provided with an opening through which a warp thread passes, these cooperating hooks (5*a*, 5*b*) take the associated warp threads to the desired height in order to produce a fabric with a well-defined pattern. The upper hoisting cord (7*a*) connects the ends of two complementary hooks (5*a*, 5*b*). The lower hoisting cord (7*b*) is connected to the harness cord.

A hoist (6) is composed of two hoisting wheels, i.e. an upper hoisting wheel (11) and a lower hoisting wheel (12), which are connected to each other. A hoisting cord (7*a*, 7*b*) runs on the outer side of a hoisting wheel. A hoisting cord (7*a*) which is connected to the complementary hooks of a hook pair runs over the upper hoisting wheel, while a hoisting cord (7*b*) which is connected to one or more heddles and retracting springs of a jacquard loom (not shown in the figure) runs around the lower hoisting wheel.

At its one end, the lower hoisting cord (7*b*) is subjected to a tensile force exerted by the spring which is connected to the heddle(s), and, at its other end, can be pulled against a setting profile (4) of the jacquard loom by means of a so-called anchor element (3) as a result of the spring action at the other end. The height of the heddle eyelets of the jacquard heddles attached to the harness cords can be adjusted by means of the setting profile (4) without the height of the entire jacquard loom having to be adjusted and thus this forms an additional setting facility. However, if a jacquard loom of such a design is provided with a removable hoist module (1), the setting profile (4) is an obstacle for the hoist module (1) during removal and/or fitting thereof.

In order, inter alia, to enable the simple and quick removal from the jacquard loom of a hoist module (1) suitable for installation in a jacquard loom, and which comprises at least one partition (2) provided for guiding hooks (5), hoists (6) and one or more hoisting cords (7) in a jacquard loom, the present invention provides a solution wherein the anchor element (3) is displaceable from a first position of use (being the position of the anchor element during normal operation of the jacquard) to a second removal position for removing the hoist module (1) from the jacquard loom. Different solutions are possible to move the anchor element (3) between both positions, as will become clear from the remainder of the description. Thus, features may be provided on or in the partitions (2) of the hoist module in which or on which an anchor element (3) is displaceable. Another option may be to configure the anchor element (3) to be rotatable, as a result of which it can be moved between a first and second position by executing a rotating movement.

FIG. 1 shows a possible embodiment of a such a module (1) which is suitable for installation in a jacquard loom according to the invention. The module (1) illustrated in FIG. 1 may be viewed as a hoist module which is configured to guide hooks (5), hoists (6) and one or more hoisting cords, and comprises two or more hook pairs which are provided with complementary hooks which cooperate with a hoist (6), wherein a number of first hoists of one or more first hook pairs are provided in an upper operating zone (A), and wherein a number of second hoists of one or more second hook pairs are provided in a lower operating zone (B).

For guiding the first hoists and the second hoists, respectively, the hoist module (1) comprises a number of partitions (2). In FIG. 1, these partitions are so-called multiple partitions which extend both between a set of two adjacently operating hoists (6) of the upper operating zone (A) and between the sets of hoists (7) of the lower operating zone (B). To this end, each multiple partition (2) comprises a first (upper) and a second (lower) partition. Both the upper and the lower partition comprise an elongate hoist-guiding slot. The length of the hoist-guiding slots is at least equal to the length of the path of the hoist (6).

Corresponding hook-guiding plates are provided for the hooks belonging to these hoists. If the hooks which are moved by the same knife are situated in one line next to each other in the jacquard, there are thus twice as many intermediate hook-guiding plates at the location of these adjacent hooks as there are partitions at the location of the hoists for each operating zone.

In a first embodiment, the multiple partition (2) may be of a single-piece design at the location of the hoists of the different operating zones. In that case, it is provided with an offset course in the longitudinal direction of the knives. In that case, a hook-guiding plate may also be connected to the partition as a single piece. Together with one or more separate hook-guiding plates, this hook-guiding plate which is fixedly connected to the partition is provided to guide one or more hooks during the downward movement which is imposed by the knives of the jacquard. To this end, these hook-guiding plates are provided with grooves in which the hooks are guided laterally. Typically, a hook-guiding plate is provided on each front and rear side, viewed along the longitudinal direction of the knives, with two grooves along the direction of movement of the hooks. This makes it possible for two successive hook-guiding plates to ensure guidance of two hooks which are situated opposite each other. In most cases, these are hooks which can be influenced by the same selection element, in order to move concomitantly or not move concomitantly with the knives. For hooks that are adjacent, viewed along the longitudinal direction of the knife, the parts which are guided in the grooves, are not necessarily situated at the same distance to the knife, which means that the grooves in the hook-guiding plates are also not necessarily situated at the same distance to said knife. The guided parts of adjacent hooks along the longitudinal direction of the knives may in each case alternately be, for example, closer to and further away from the knife, as a result of which the grooves in the hook-guiding plates are also alternately closer to and further away from the knife, viewed in the longitudinal direction of the knife.

The grooves may preferably also have a recess or a protuberance and the guided parts of the hook may have a protuberance or a recess, respectively, which cooperates therewith, as a result of which the hooks can be locked in a transport position, for example in order to facilitate the removal of a hoist module.

The multiple partition (2) may also be composed of two single partitions which, in this case, have to be provided with positioning openings and/or surfaces, so that assembly to form a multiple partition (2) can be effected in a simple manner. The various single partitions may, for example, be provided with an opening (14) through which a profile can be pushed, so that the height position of the partitions is ensured. This profile may for example be a shaft or a pipe with a cross section which is round, oval or of a different design. In order to prevent the partitions from rotating with respect to each other after they have been pushed onto a round profile, the partitions comprise a number of locking elements (surfaces).

However, it is obvious that the present invention is not limited to hoist modules (1) with associated hoists distributed over two operating zones, but that hoist modules (1) with associated hoists distributed over one or more operating zones also fall within the scope of protection of this invention.

The combination of partitions (2), hook-guiding plates, hooks, hoists and hoisting cords may also be assembled in order to thus form a module which is more easily removable during repair or replacement work is and can readily be put back in place.

The modules may, for example, contain between 10 and 400 hooks, in each case with associated hoists distributed over one, two or more operating zones, also with partitions and hook-guiding plates.

In a preferred embodiment, the modules (1) comprise between 120 and 280 hooks, in a further preferred embodiment approximately 200.

For these embodiments, a number is preferably chosen which can readily be divided and which is a multiple of a large number of figures, so that the jacquard can readily be divided into zones, for example for the different colours in a face-to-face weaving loom. Typical embodiments therefore have a number of hooks which is the product of a number of times the FIG. 2, 3 and sometimes 5: Number of hooks is then for example $H=2^i*3^j*5^k$ with i and j=1 to 8 and k=0 to 2; typical values for H are then: 16, 24, 32, 48, 60, 64, 72, 80, 96, 108, 120, 144, 160, 192, 240, 256, 320, 384.

The hooks may also differ with respect to shape and length within a module (1). In a preferred embodiment, the module (1) contains hooks of two different lengths which alternate in the longitudinal direction of the knife. As a result thereof, it is also possible for the selection elements to be at 2 levels, which is advantageous to provide several selection elements on a given surface area, the so-called footprint.

Such modules are preferably provided with specific hook guides before the first and after the last hook. In a further preferred embodiment, specific embodiments of the partitions and hook guides may be provided at certain positions in the module, for example in order to support the module locally or in order to maintain the correct position with respect to the associated selection elements (not shown) which may optionally also be spaced at a different distance apart in accordance with a certain interval.

The selection elements do not per se form part of the device (hoist module) according to the invention, so that the hoist module does not have to be replaced in case of defects in the selection elements. This offers significant advantages, not only with regard to price, but also to ease of use, since the connection with the heddles does not have to be released. Conversely, when hoist modules are replaced, the selection elements do not necessarily have to be replaced as well, which again offers a cost price advantage to the user.

In order to connect adjacent, optionally multiple partitions (2) to one another and keep the hoisting cords in place, the module (1) further comprises a bridge element (15). The hoisting cords run through the openings which were formed after the bridge element (15) was connected to the partitions. This contributes to a quicker removal of the hoist modules, as the associated hoisting cords do not obstruct one another or make contact with those parts of the jacquard loom which are not to be removed.

As has been mentioned above, the module (1) may be provided with an additional setting option in order to change the mean position of certain heddles per group. The operation thereof will be explained in detail with reference to FIG. 2.

Figure 2:
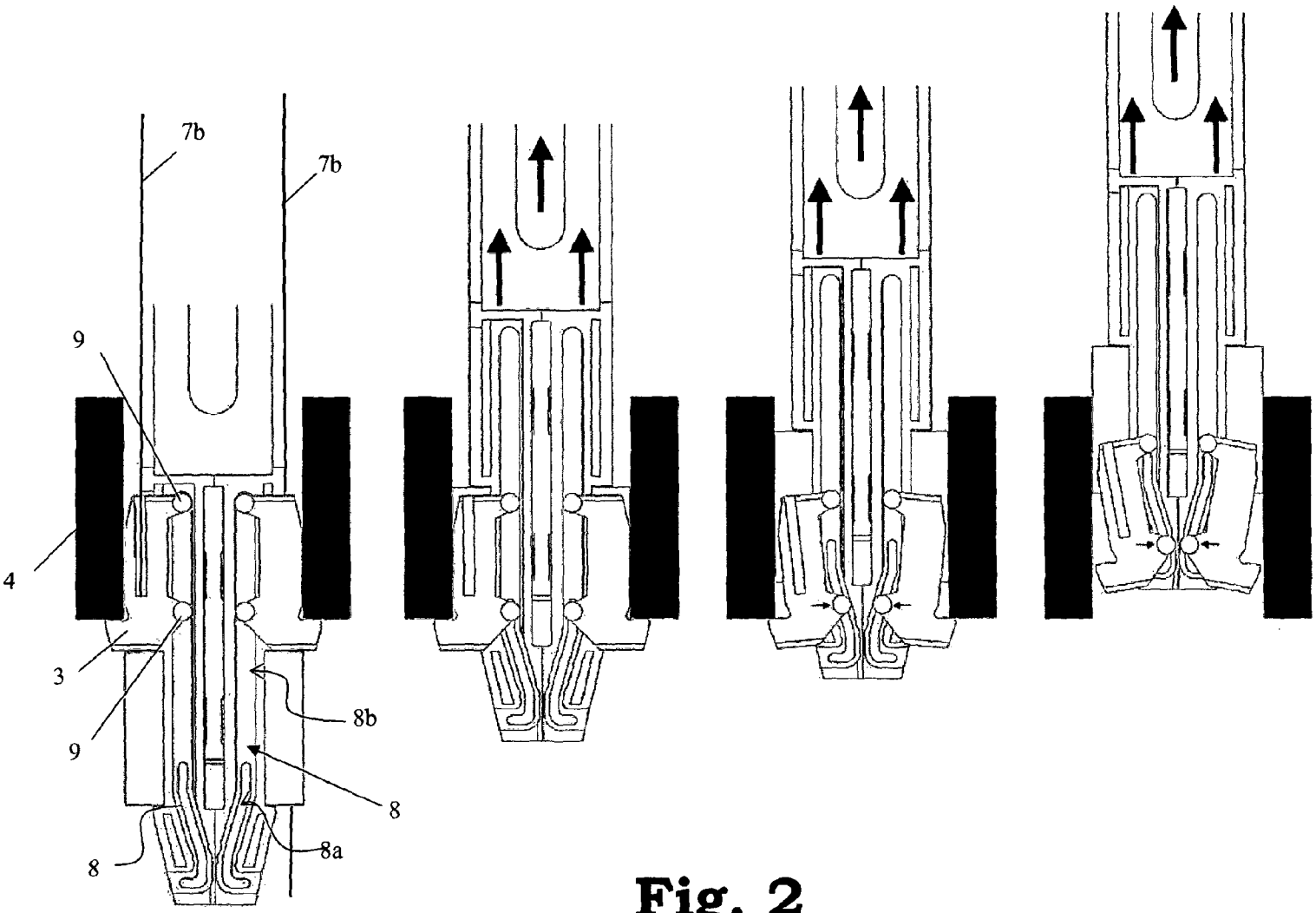
FIG. 2 is a representation of a number of intermediate positions during the removal of a module with hoists, hoisting cords.

At one end, a lower hoisting cord (7*b*) is subjected to a tensile force as a result of the spring which is connected to the heddle(s) and, at its other end, it is pulled with an anchor element (3) which is connected to the other end against a setting profile (4) of the jacquard device as a result of the spring action at the other end, as can be seen in FIG. 2. The setting profile (4) applies a force on the anchor element (3) which is substantially counter to the removal direction of the hoist module (1) from the jacquard. The anchor element (3) in each case comprises two guiding protrusions (9) which are provided on each front and rear side to be guided in a groove (8) of the partition (2), in particular the groove is arranged on the underside of the partition (2).

This groove (8) may run along the adjustment direction of the setting profile in the setting region for the setting facility of the heddle height per group. The groove in the setting region may be referred to as the setting portion (8*b*) of the groove.

In order to ensure quick removal of the hoist module (1) along the setting profile (4), the groove (8) in the partition may comprise a portion which runs in a direction which ensures a lateral movement of the anchor element (3) upon removal of the hoist module (1), away from a part of the jacquard loom which is not connected to the hoist module (1), such as for example the abovementioned setting profile or a fixed part of the jacquard loom. In this way, the anchor element (3) can be moved from a first position of use to the second removal position. The anchor element (3) secures the hoisting cord which is connected to at least one harness cord and the heddle which is connected thereto. The anchor element may be configured to be block-shaped and be provided with protrusions which slide in the groove. This second portion of the groove may be referred to as the tilting portion (8*a*).

The groove (8) in the partition may have both a setting portion (8*b*) in the direction of the adjustment direction of the setting profile and a tilting portion (8*a*) which ensures that the anchor element moves laterally.

In the following, FIGS. 3 to 7 which show a number of possible embodiments of the hoist module (1) according to the invention are discussed in more detail.

Figure 3A:
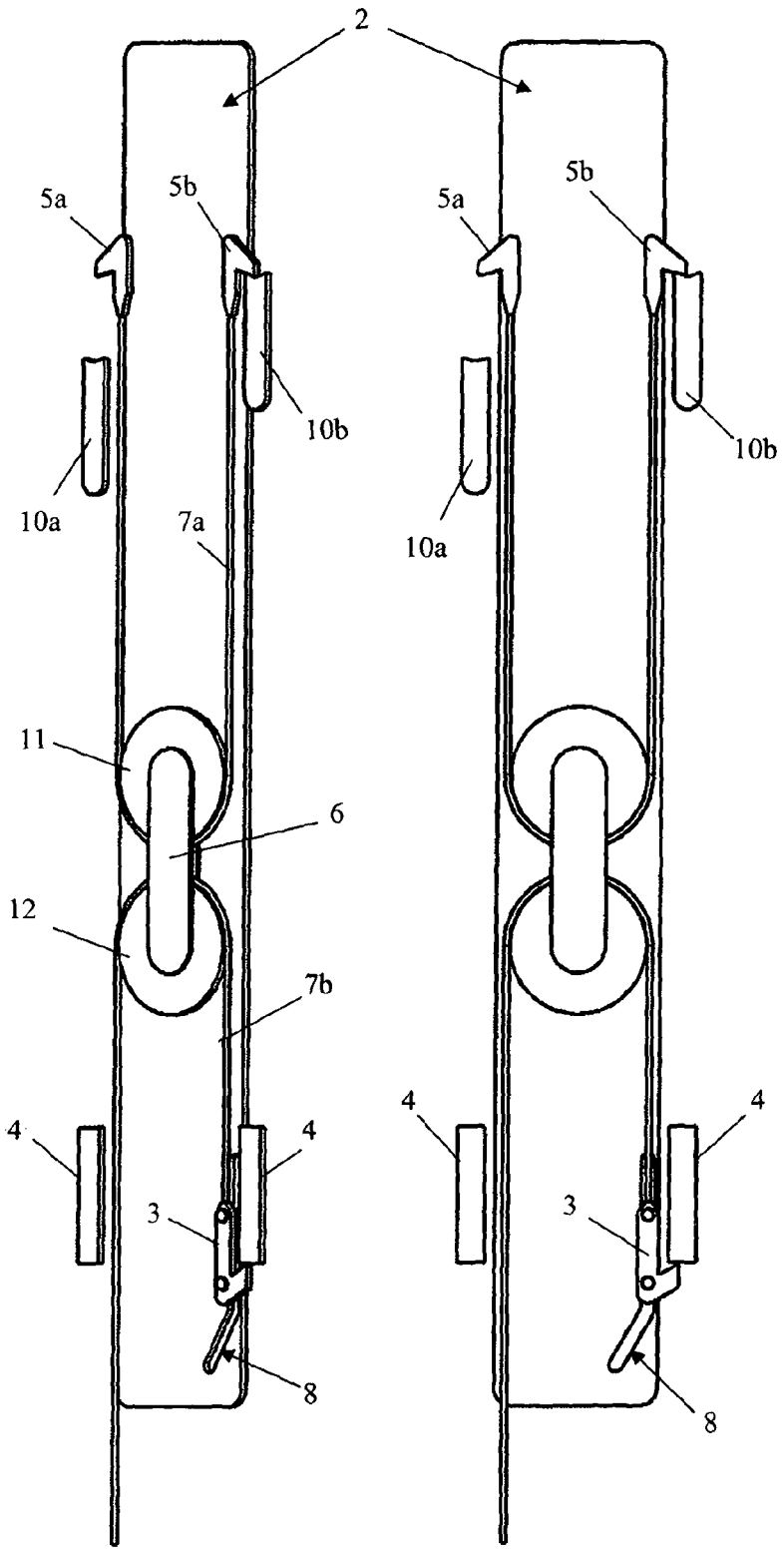
FIG. 3*a* is a diagrammatic representation of a module for actuating a heddle in two possible positions, with anchor elements which are configured to cooperate with one or more setting profiles which are situated on the outer side of the module.

FIG. 3*a* shows two cooperating hooks (5*a*, 5*b*) which are connected by an upper hoisting cord (7*a*) running over a first wheel (11) which forms part of a hoist (6) comprising two wheels. Via an anchor element (3) which contacts a setting profile (4) which is connected to the device, a lower hoisting cord (7*b*) is, via the second wheel (12) of the hoist (6), connected to one or more heddles provided with heddle eyelets through which warp threads extend and by means of which the position of the warp threads with respect to a weft insertion means is determined, so that fabric can be woven according to a specific pattern.

During normal operation of the jacquard, at least two knives (10*a*, 10*b*) move in counterphase for each hoist module, per weft insertion cycle of the associated weaving loom, according to a rectilinear movement, either upwards or downwards, with approximately the same amount of movement, and the associated cooperating hooks can be selected in the vicinity of a limit position (in this case the upper) to not move further concomitantly with the knife and thus to stop or stay in the immediate vicinity of said limit position. If both cooperating hooks are situated on the associated knives, then the heddle is in the lower position. As soon as one hook is staying in the upper position, the associated knife then moves away from the hook and the knife moving in counterphase and associated with the cooperating hook moves the latter hook upwards, so that an upper position for the heddle is reached. This hook may also stay, so that the upper position can be maintained. If this is the case, then a decision can be made at each subsequent cycle, when a knife approaches its associated hook, to allow the hook to move concomitantly with the knife during the next cycle, as a result of which it leaves the upper position and is moved to the lower position.

The other end of the heddle is provided with retracting elements, as a result of which the anchor element (3) is pulled against the setting profile (4) so that the hooks are pulled against their associated knives when they contact each other. The anchor element (3) preferably contacts the setting profile (4), in which case the contact force which is exerted by the setting profile (4) on the anchor element (3) has at least one component in a direction which is opposite to the desired removal direction of the hoist module (1).

When removing the hoist module (1) in an upward direction, the anchor element (3) is prevented by the setting profile (4) from moving along, but it is gradually moved away from the setting profile (4) by a guiding passage (8) in the partition (2), so that the anchor element (3) can finally pass the setting profile (4), as a result of which the hoist module (1) can be removed further. Therefore, protrusions (9) are provided on the anchor element (3) which guide in a groove (8) of one or more partitions (2).

In addition to the portion of the groove which allows a lateral movement away from the setting profile, FIG. 3*a* also shows a groove portion which is in line with the removal direction; in the fitted position of the hoist module in the shed-forming device, a displacement of the setting profile (4) along this removal direction, and wherein the anchor element does not enter the zone of the groove (8) which imposes lateral movement, will influence the position of the heddle eyelet and this is in addition with respect to the movement imposed by the knives. In this way, it is possible to achieve a central setting for several heddle eyelets in a simple manner. This setting profile (4) can also be driven to impose a controlled additional movement on the heddle eyelets, the associated anchor element (3) of which contacts this setting profile.

In another embodiment (not illustrated in the attached figures), the controlled movement can be imposed via the setting profile by means of a coupling to a component of the jacquard drive which is already moving, if desired in combination with a reinforcement of this movement. In addition, it is even possible to conceive of a separate drive, for example using a separate motor, per setting profile or per group of setting profiles, so that free control for the controlled additional movement of the heddle eyelets is possible.

Figure 3B:
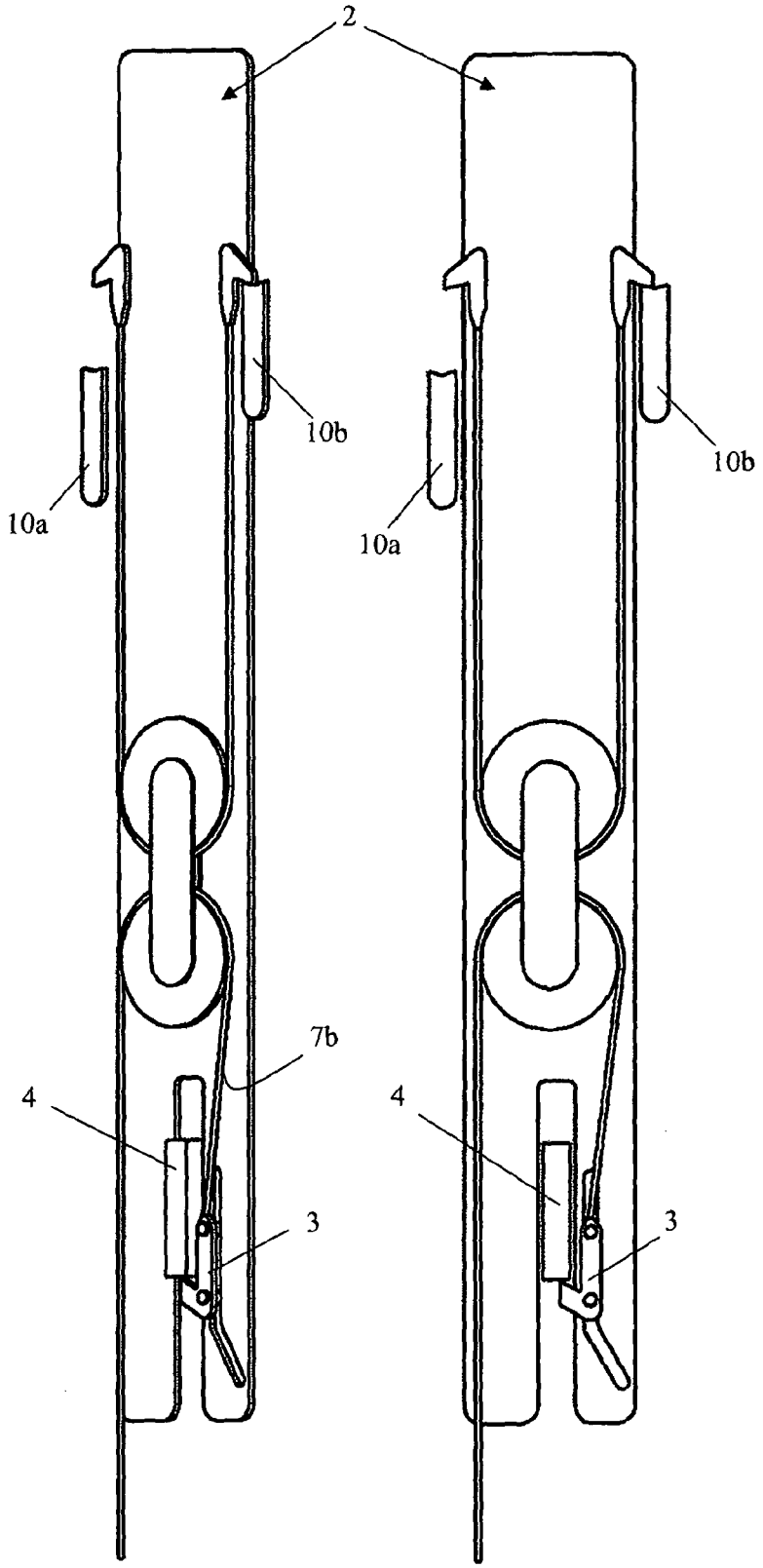
FIG. 3*b* shows a variant of the representation shown in FIG. 3*a* with anchor elements which are configured to cooperate with one or more setting profiles which are situated on the inner side of the module.

FIG. 3*b* shows a variant of FIG. 3*a*, in, which the setting profile (4) is situated under the hoist element and thus between the associated hooks, whereas in FIG. 3*a* it is situated next to the hoist element or between neighbouring hoist systems which belong to different pairs of knives moving in counterphase. FIG. 3*b* thus shows an embodiment in which the setting profile associated with a module makes contact, via a slot opening at the bottom of the module, with the anchor elements which, in the mounted position in the jacquard and during normal operation, protrude with respect to the slot opening in order to contact the setting profile, this on condition that a tensile force is exerted on the cord connected to the anchor element, for example by the retracting springs which are attached to the harness.

FIG. 3*c*1 shows a number of hook systems associated with the same knife pair, with associated hoists and anchor elements, in which all anchor elements can contact one setting profile (4). FIG. 3*c*2 shows the same, but in this case, anchor elements of hook systems associated with the same knife pair contact two different setting profiles.

Figure 3D:
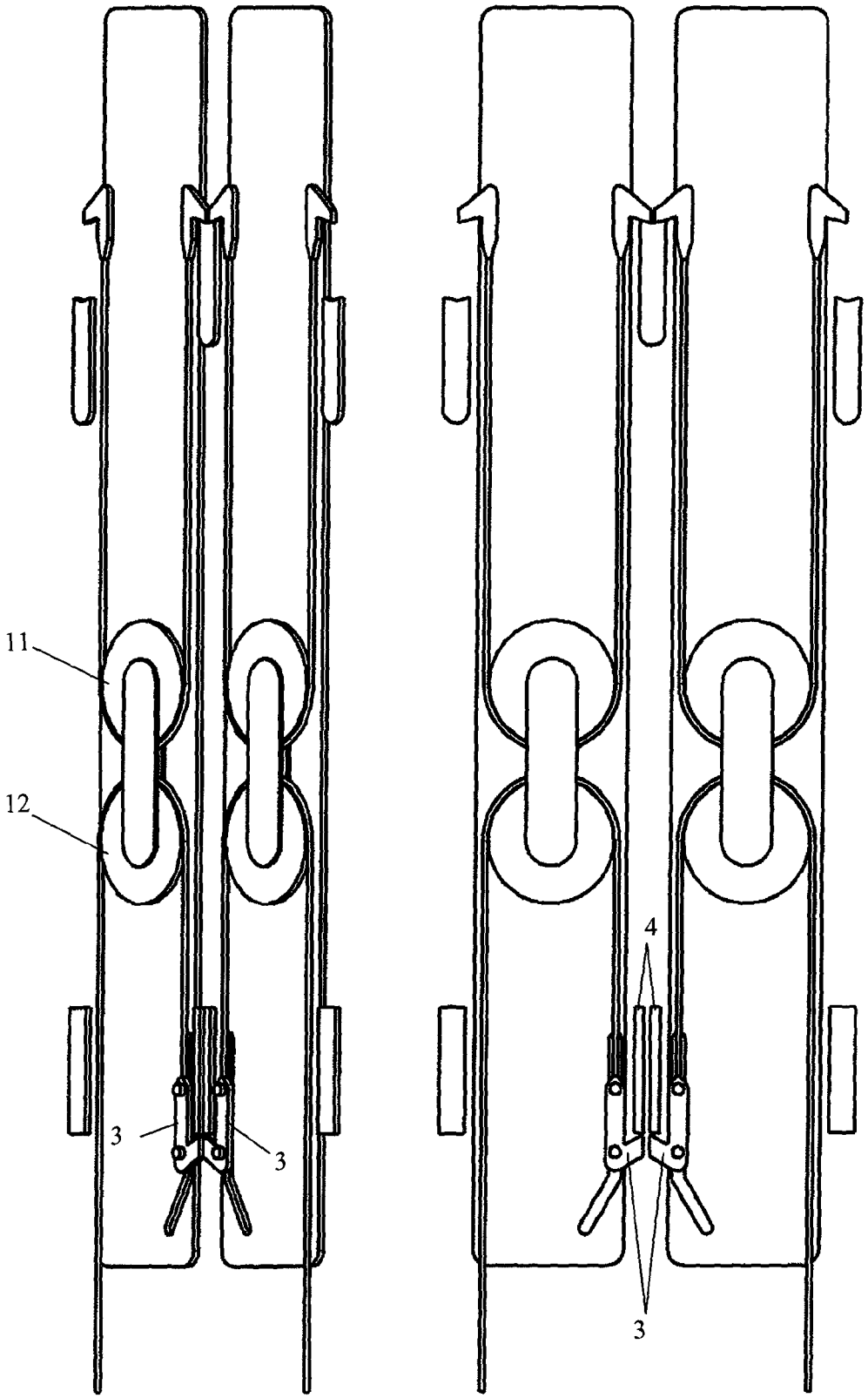
FIG. 3*d* is a representation which shows that anchor elements of adjacent hook systems can contact the same setting profile or a different setting profile.

The anchor elements (3) of adjacent hook systems, for example of another hoist module (1), each with their knife pairs moving in counterphase, can contact the same setting profile (4) or can each contact their own setting profile, as is shown in FIG. 3*d*.

Figure 4A:
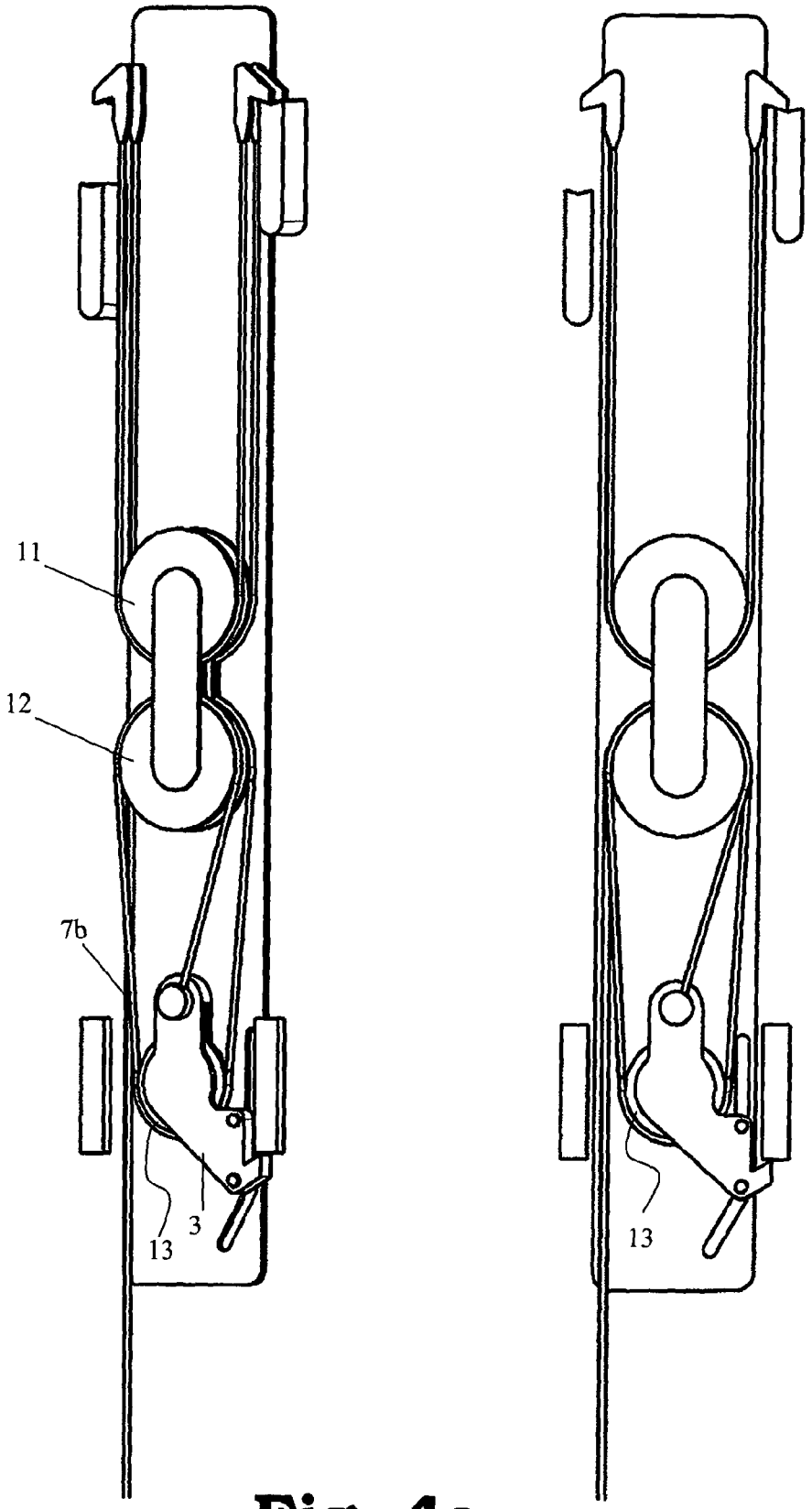
FIG. 4*a* is a representation of a module in which the anchor element is both a fastening element for an end of the lower hoisting cord and a fastening element for a reversing roller.

FIG. 4*a* shows a solution in which the lower hoisting cord (7*b*) is controlled by two pairs of cooperating hooks, each provided with an intermediate selection element, for example an electromagnet, at the location of the free ends of the hooks, and in which the anchor element (3) is also provided with a reversing roller (13) around which the lower hoisting cord is folded. This is a solution which is typically suitable for constructing a full 3-position jacquard, in which the combinations of positions of the associated hooks result in 3 different possible positions of the heddle eyelets connected thereto, and wherein each of the 3 positions can be reached after each weft insertion cycle. In the solution illustrated in FIG. 4*a*, the anchor element (3) is both a fastening element for an end of the lower hoisting cord (7*b*) and a fastening element for a reversing roller.

Figure 4B:
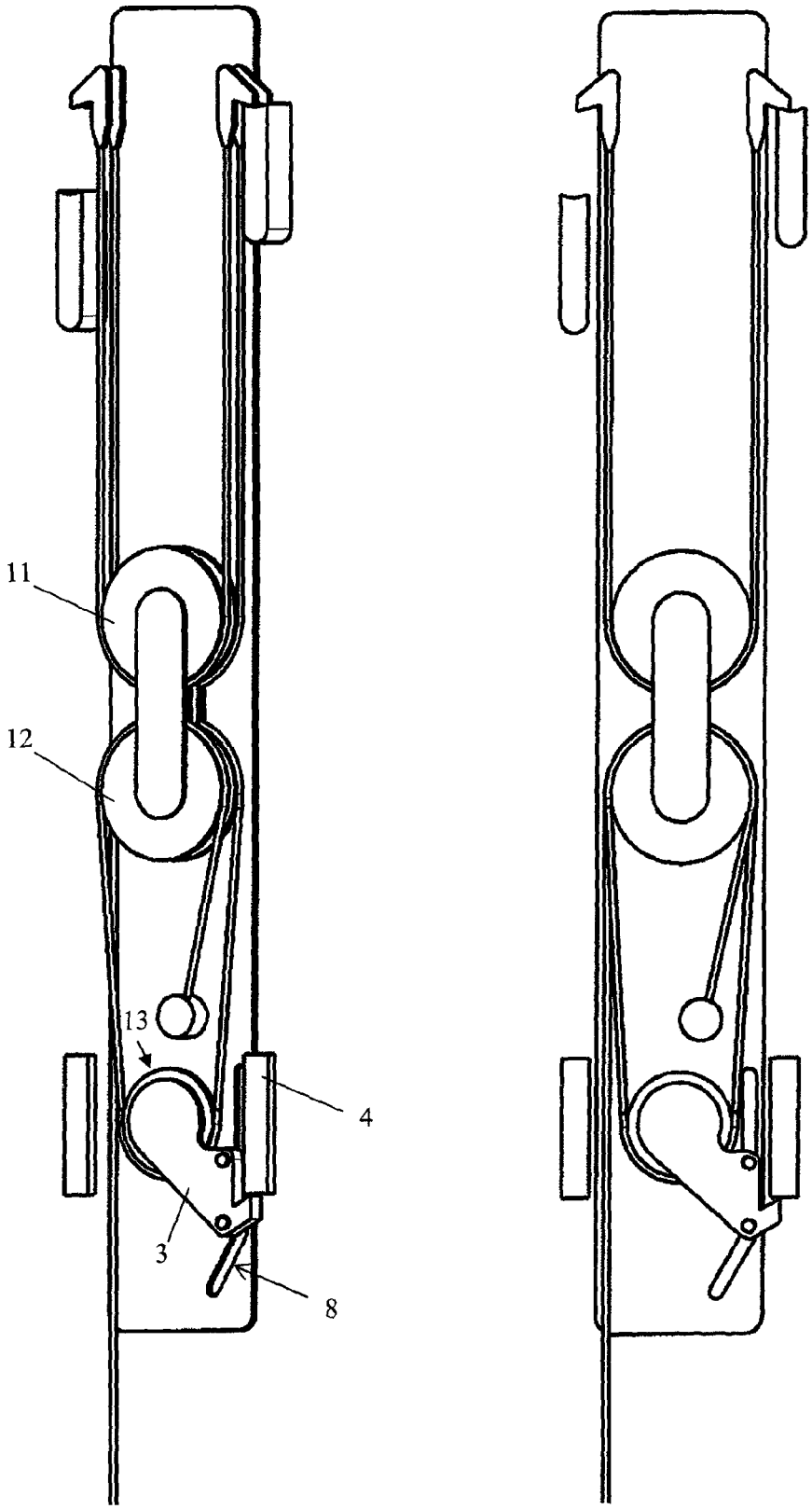
FIG. 4*b* is a representation of a part of a hoist module, in which the anchor element is only the fastening element for a reversing roller.

In FIG. 4*b*, the anchor element (3) is only a fastening element for a reversing roller. The end of the hoisting cord is attached to the hoist module (1) and the guiding passage (8) in the partition (2), in combination with a displacement of the setting profile (4), ensures a displacement of the reversing roller (13), so that an additional displacement of the heddle eyelets connected to the anchor element is imposed here too. In addition, the second portion of the guiding passage again ensures that the anchor element folds away in a direction which has a directional component which is at right angles to the removal direction, so that the hoist module can be removed.

Figure 4C:
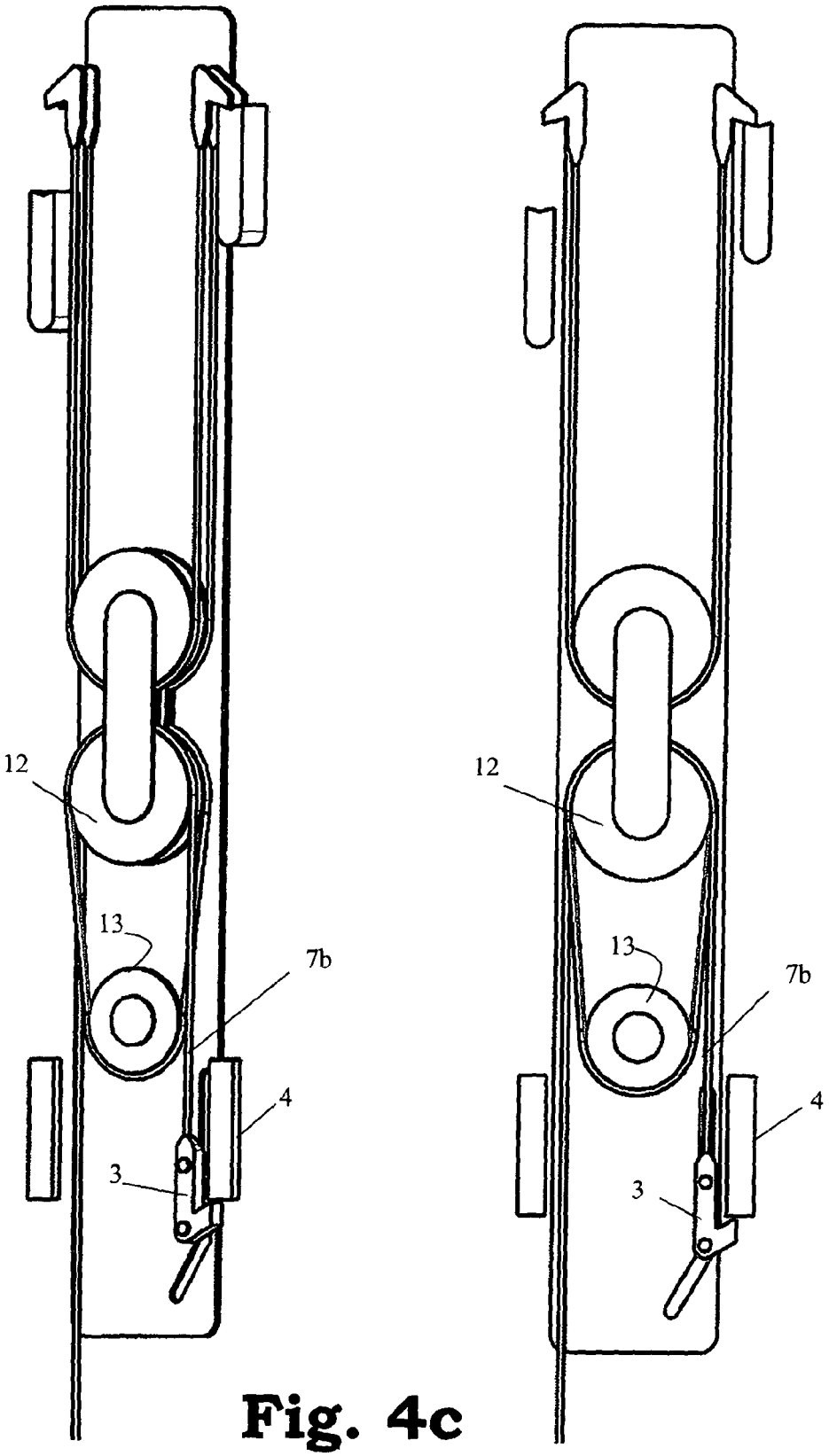
FIG. 4*c* is a representation of a part of a hoist module in which the anchor element is only the fastening element for the end of the lower hoisting cord.
Figure 4D:
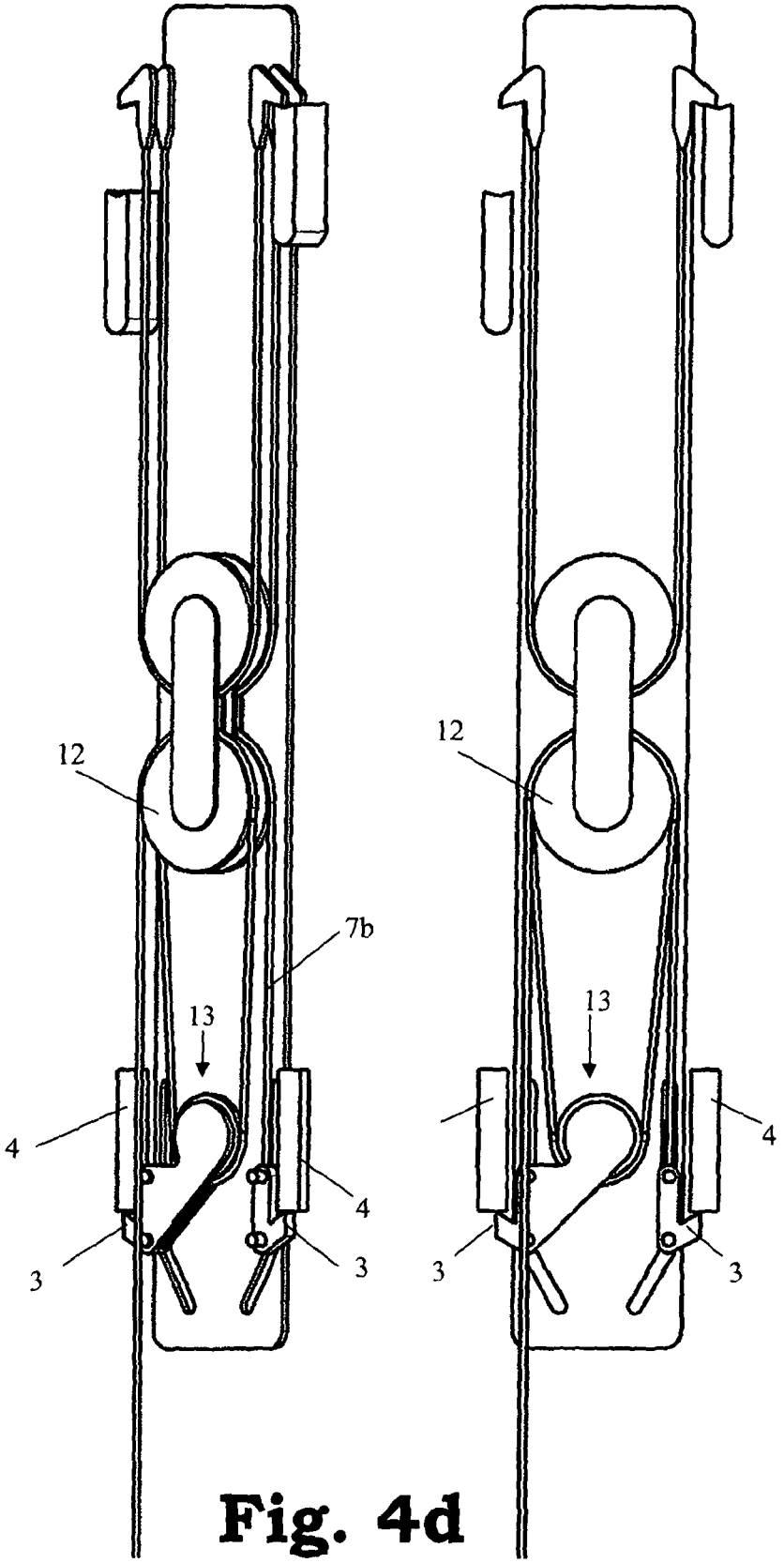
FIG. 4*d* is a representation of a part of a hoist module, in which two anchor elements are provided per lower hoisting cord.

In FIG. 4*c*, the anchor element is only a fastening element for the end of the lower hoisting cord (7*b*) and the reversing roller (13) is connected to the hoist module. In FIG. 4*d*, two anchor elements are provided for each lower hoisting cord: one with fastening element of the end of the lower hoisting cord and one with the reversing roller. This results in additional adjustment possibilities which are advantageous for a full 3-position system.

Figure 5A:
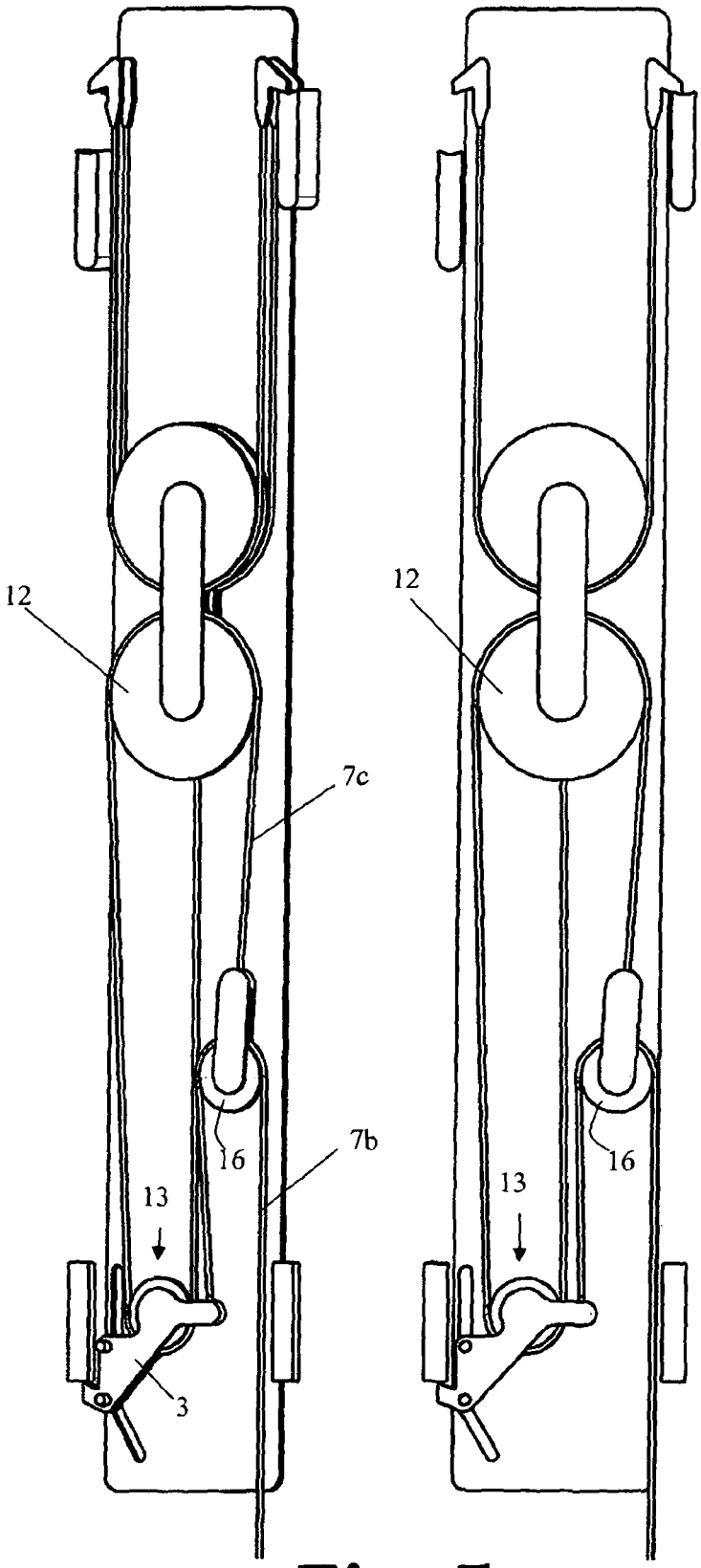
FIG. 5*a* shows a solution for a full four-position system.

FIG. 5*a* illustrates a solution for a full 4-position system, and wherein each of the four positions can be reached after each weft insertion cycle. In the illustrated solution, the lower hoisting cord (7*b*) is connected to the anchor element (3) at one end and is also turned over a wheel (16) which is attached to the first hoist (6) of a second pair of cooperating hooks, via an intermediate hoisting cord (7*c*) over the second hoisting wheel (12) of the first hoist (6) of a first pair of cooperating hooks and over a reversing roller (13) which is situated on the anchor element (3).

Figure 5B:
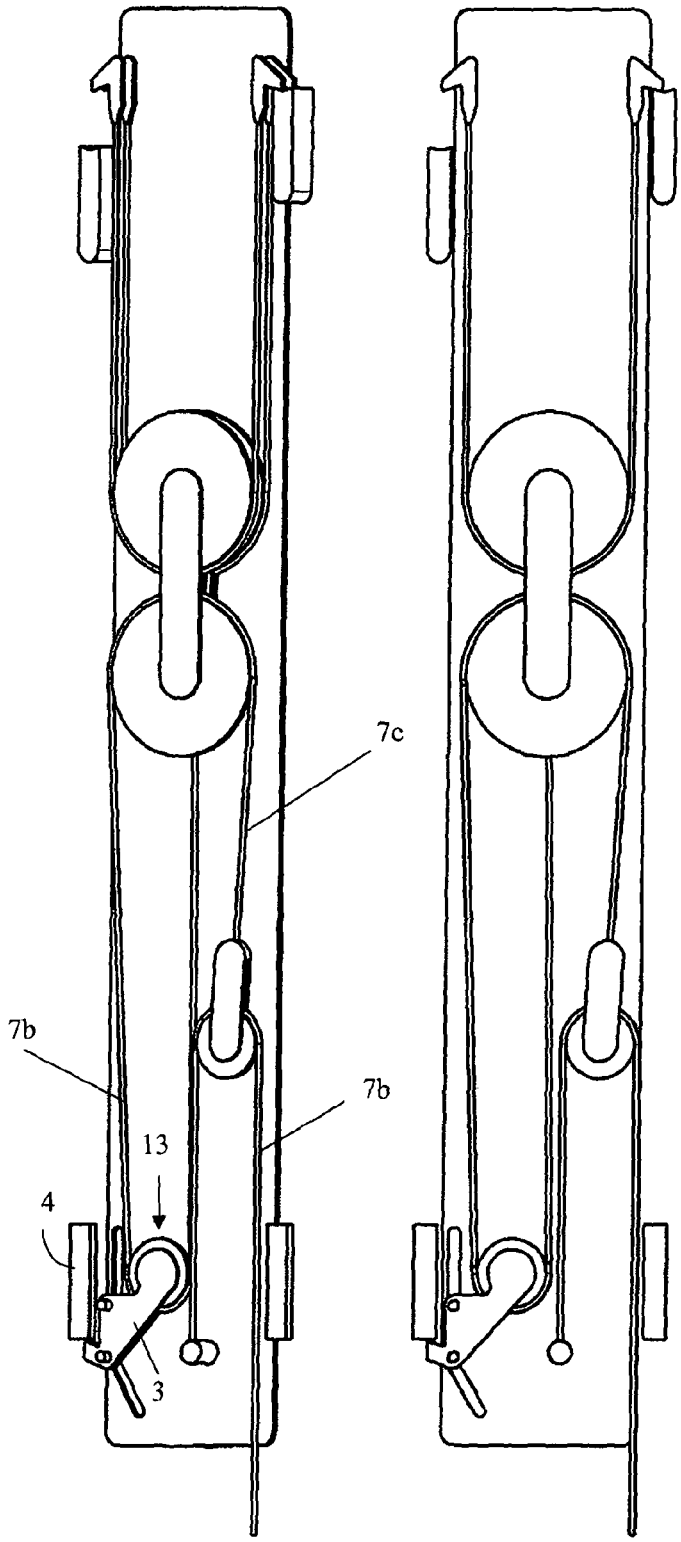
FIG. 5*b* shows a variant of FIG. 5*a*, in which the anchor element is only a holder for a wheel which acts as a deflecting wheel for an intermediate hoisting cord.

In FIG. 5*b*, the anchor element (3) is only a holder for a wheel which serves as reversing roller for the intermediate hoisting cord, and the end of the lower hoisting cord is fixedly attached to the hoist module.

Figure 5C:
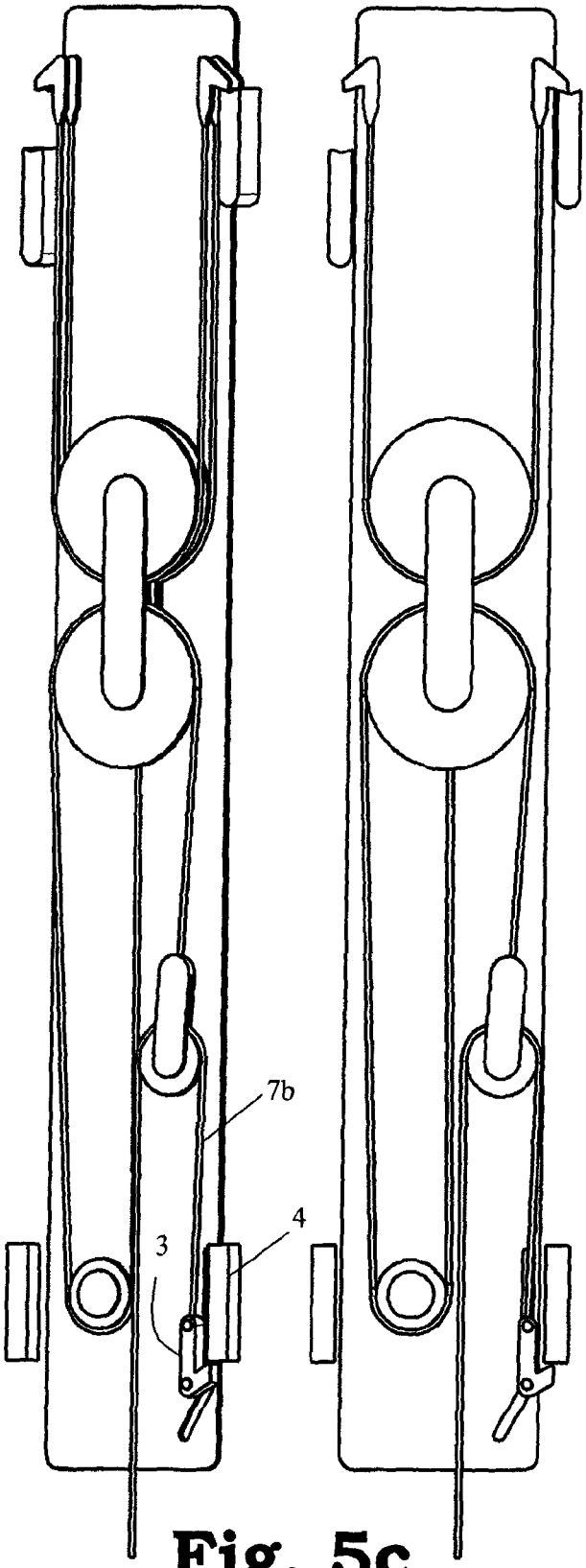
FIG. 5*c* shows a variant of FIG. 5*a*, in which the anchor element is only a holder for the end of the lower hoisting cord.

In FIG. 5*c*, the anchor element is only a holder for the end of the lower hoisting cord, and the wheel which serves as a reversing roller for the intermediate hoisting cord is fixedly attached to the hoist module.

Figure 5D:
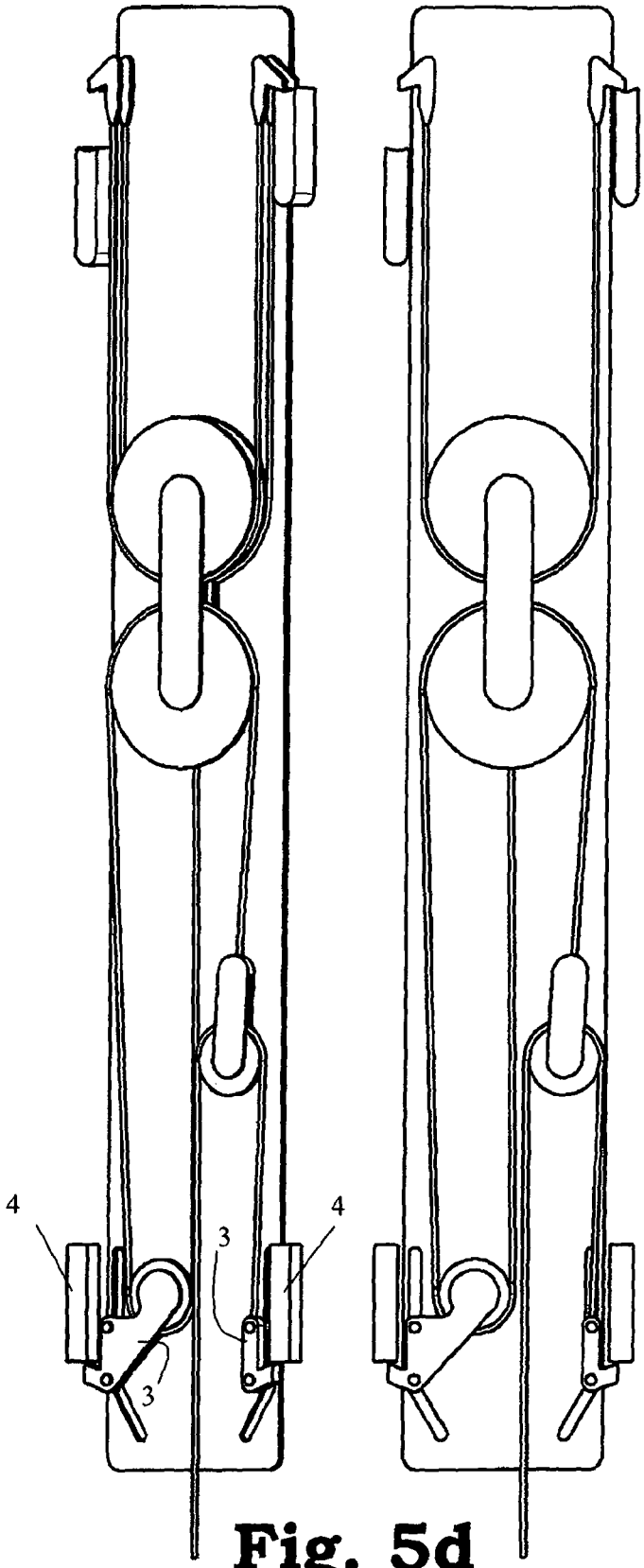
FIG. 5*d* is a representation wherein, similar to FIG. 4 *d*, two anchor elements are provided per lower hoisting cord.

In FIG. 5*d*, two anchor elements (3) are again provided per lower hoisting cord, with the same advantages as described in connection with FIG. 4*d*.

Figure 6A:
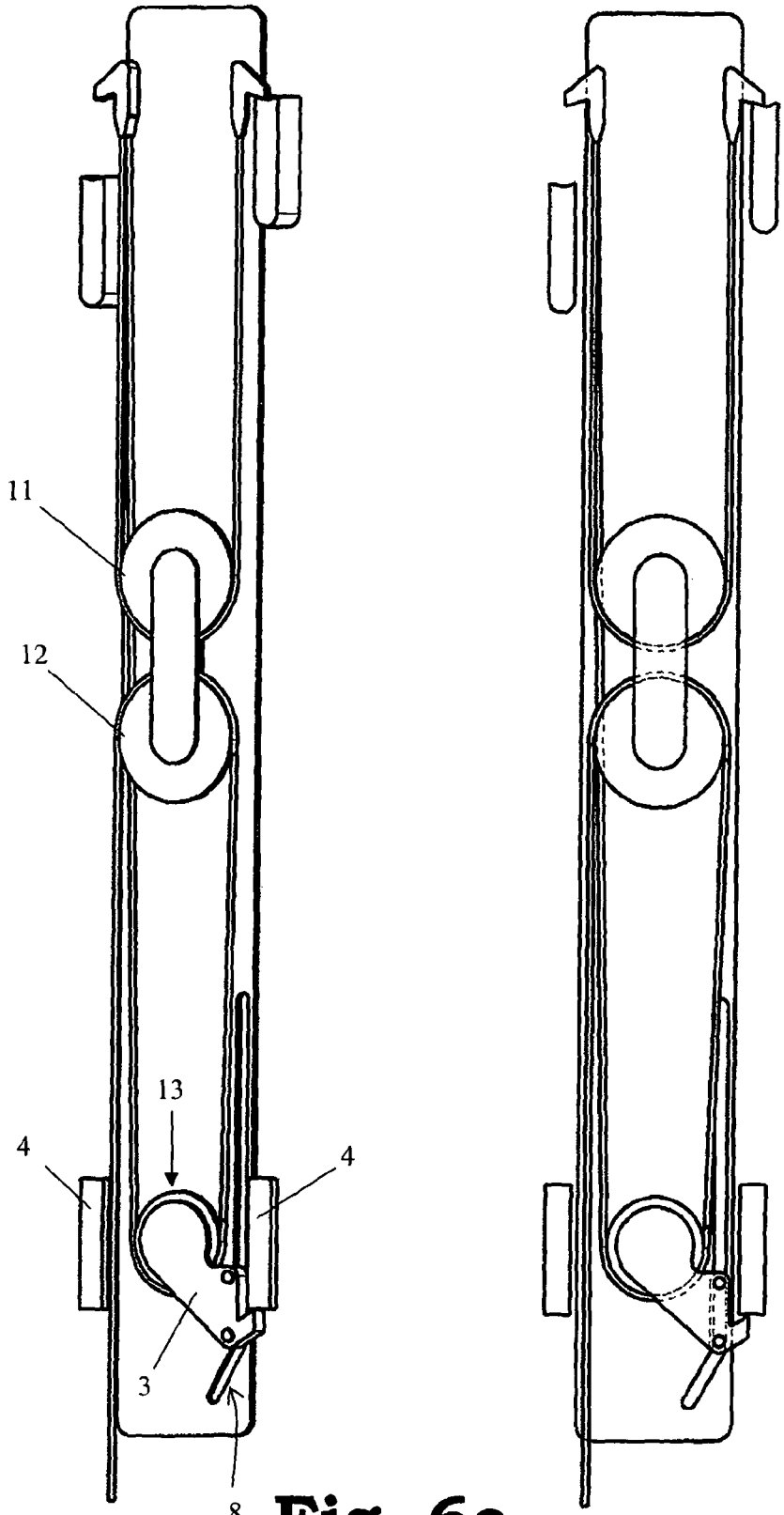
FIG. 6*a* shows a solution with a hoist system for a jacquard loom with a movable grid.

FIG. 6*a* shows the hoist system for a jacquard loom with a movable grid. Such a jacquard loom provides 3 positions for the heddles which are connected thereto, but the 3 positions cannot always be reached after each weft insertion cycle. However, the advantage is that 3 positions are possible using only two hooks. The lower hoisting cord (7*b*) is fixedly attached to one of the two hooks and the setting profile (4) which contacts the anchor element (3) to which only the reversing roller is attached moves concomitantly with one of the knives. To this end, the guiding passage (groove) (8) is longer than with the previous solutions. The distance at which the setting profile is kept with respect to the knife can still be adjusted, so that here as well an additional displacement of the heddle eyelets whose associated anchor elements bear against a setting profile is possible.

Figure 6B:
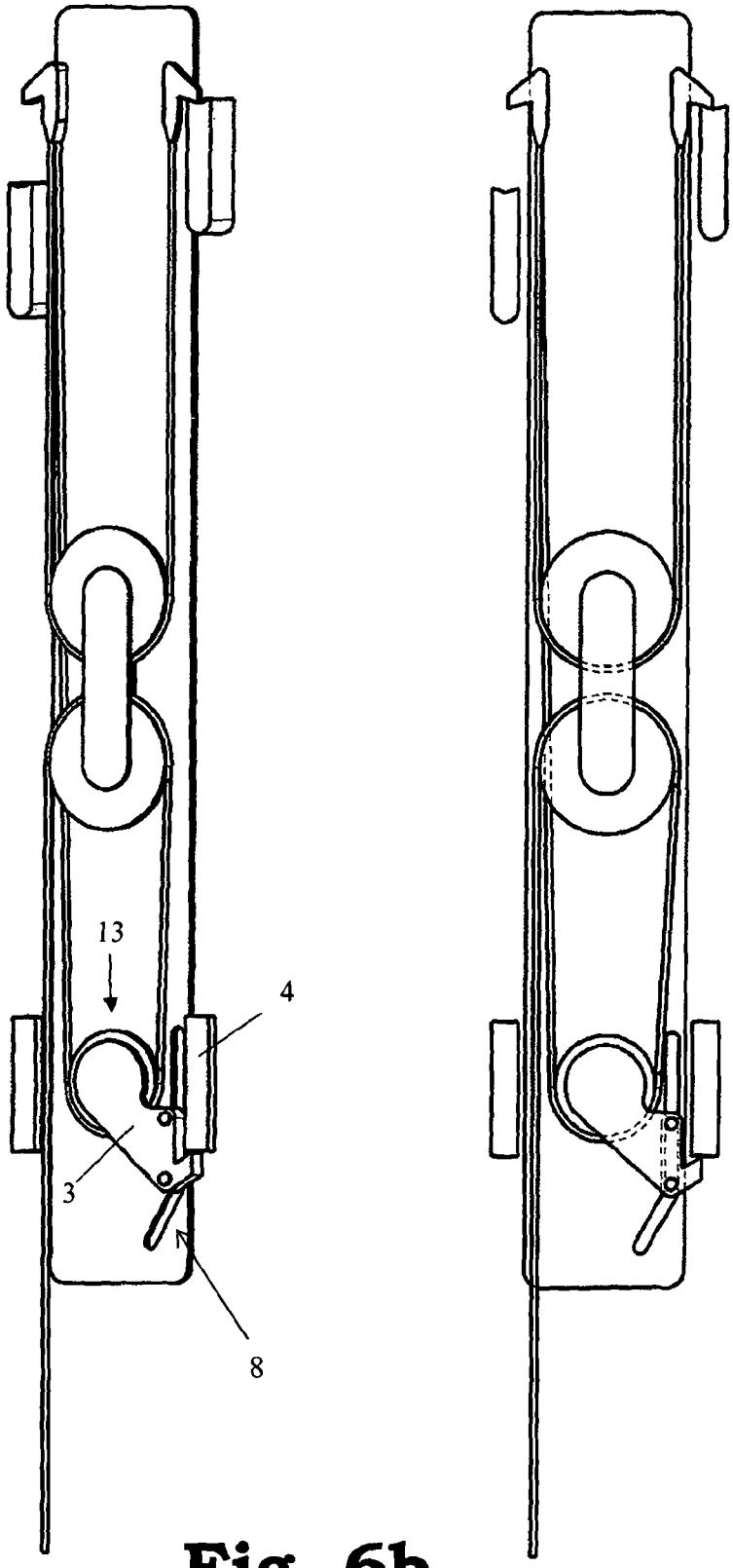
FIG. 6*b* shows a system similar to that from FIG. 6*a*, but where the setting profile is not connected to one of the knives.

The solution shown in FIG. 6*b* is completely identical to the solution from FIG. 6*a*, except that the setting profile is not connected to one of the knives here. As a result thereof, the order to the positions which can be reached differs from those of the solution in FIG. 6*a*.

Finally, FIGS. 7.1 and 7.2 show an alternative for the guiding groove in the hoist module. Here, the tilting movement is imposed by a wedge-shaped element which is pressed against the anchor elements. In the illustration in FIGS. 7.1 and 7.2, two anchor elements are influenced simultaneously by the wedge-shaped element (17), but this may, of course, also be a single anchor element. In addition, it is also possible to use spring elements in order to support the action of rotating away. A groove for additional setting of the heddle eyelet position has not been shown, but may be added.

The invention claimed is:

1. Module suitable for installation in a jacquard machine, comprising shed-forming elements and at least one partition provided for guiding the shed-forming elements;

wherein the shed-forming elements comprise at least one anchor element which is configured to be held pressed against a contact profile of the jacquard machine when the module has been installed in the jacquard machine;

wherein said anchor element is displaceable from a first position of use to a second removal position for removing the module from the jacquard machine;

wherein the anchor element is configured such that when the module has been installed in the jacquard machine and the anchor element is in the first position of use the module can be used but cannot be removed from the jacquard machine, and such that when the module has been installed in the jacquard machine and the anchor element is in the second removal position the module cannot be used but can be removed from the jacquard machine.

2. Module according to claim 1, characterized in that said anchor element is configured to be connected to a hoisting cord which is configured to be connected to a part of the jacquard machine.

3. Module according to claim 2, characterized in that the anchor element exerts a pressing force on the contact profile in a direction which is opposite to the tensile force which the hoisting cord which is connected to the anchor element exerts on the jacquard machine.

4. Module according to claim 1, characterized in that said contact profile is a control profile.

5. Module according to claim 1, characterized in that said partition comprises a guide which is configured to displace the anchor element from the first position of use to the second removal position.

6. Module according to claim 5, characterized in that said guide has a course which allows the anchor element to be moved laterally.

7. Module according to claim 5, characterized in that the guide is a groove.

8. Module according to claim 5, characterized in that the anchor element comprises at least one protrusion which can be guided in said guide.

9. Module according to claim 5, characterized in that the guide, in a first part, extends in a first direction along the removal direction of the module and, in a second part, extends in a second direction which differs from the first.

10. Module according to claim 1, characterized in that said anchor element is rotatable from the first position of use to the second removal position.

11. Module according to claim 1, characterized in that said module is a hoist module comprising at least one partition provided for guiding hooks, hoists and one or more hoisting cords in a jacquard machine.

12. Jacquard machine provided with an adjustable contact profile, characterized in that the jacquard machine comprises at least one module according to claim 1.

13. Module according to claim 1, wherein the anchor element is configured such that, when the module has been installed in the jacquard machine, the anchor element is always in either the first position of use or the second removal position.

* * * * *